US005397016A

United States Patent [19]

Torrence et al.

[11] Patent Number: 5,397,016

[45] Date of Patent: Mar. 14, 1995

[54] MERCHANDIZER FOR CIGARETTE PACKAGES AND THE LIKE

[75] Inventors: Arthur L. Torrence, Newtown; William A. Lush, Stamford, both of Conn.

[73] Assignee: Mechtronics Corporation, Stamford, Conn.

[21] Appl. No.: 202,778

[22] Filed: Feb. 28, 1994

[51] Int. Cl.[6] ..... G07F 11/12

[52] U.S. Cl. ..... 221/11; 221/104; 221/107; 221/111

[58] Field of Search ..... 221/11, 14, 103, 104, 221/106, 107, 108, 111, 112, 114, 133

[56] References Cited

U.S. PATENT DOCUMENTS

| | | | |
|---|---|---|---|
| 2,197,633 | 4/1940 | Grenier | 221/104 |
| 2,379,501 | 7/1945 | Steiner et al. | 221/104 X |
| 2,501,816 | 3/1950 | Holinger | 221/104 |
| 2,585,872 | 2/1952 | Steiner | 221/104 X |
| 3,053,599 | 9/1962 | Mortara | 221/11 X |

FOREIGN PATENT DOCUMENTS

| | | | |
|---|---|---|---|
| 433092 | 2/1992 | Japan | 221/11 X |

*Primary Examiner*—Robert P. Olszewski
*Assistant Examiner*—Dean A. Reichard
*Attorney, Agent, or Firm*—Haynes N. Johnson

[57] ABSTRACT

A package merchandiser providing for front and rear stacks of packages resting on a common sloping surface, with a rotating gate positioned between the two stacks to prevent the rear stack to slide to the position of the front stack while packages remain in the front stack. The rotating gate releases when no packages remain in the front stack, allowing the packages in the rear stack to move forward. A control cam associated with the rotating gate to additionally control motion of the rotating gate.

14 Claims, 4 Drawing Sheets

MERCHANDIZER FOR CIGARETTE PACKAGES AND THE LIKE

FIELD OF THE INVENTION

This invention relates to merchandisers for packages of cigarettes and similar items. In particular, it relates to merchandisers which dispense one package at a time from a stack of packages, and which include a system by which a second stack can be loaded into the unit while the first is being dispensed.

BACKGROUND OF THE INVENTION

In the past, cigarette merchandising devices, of the type which allow a retailer to take one package at a time from the bottom of the unit, could only be reloaded during use by adding new packages to the top of the working stack. This limited the number of packages which could be carried by the merchandiser and left the possibility of the unit running out of cigarettes.

BRIEF SUMMARY OF THE INVENTION

The present merchandiser will be described with reference to cigarette packages, but it can also be used for other similar packages.

The merchandiser dispenses packages of cigarettes from a front stack or column (the "sell" column) located in the front of the unit, and also provides for a second stack or column (the "back-up" column) to be loaded into the rear of the unit. When the bottom pack from the front stack is removed, the stack will drop to position another pack for removal. When the front stack is used up, the rear stack slides into position in the front, so that it can be used. A new second stack can then be placed in the rear of the unit.

This result is accomplished by having both stacks positioned on a sloping surface, tilting toward the front, and by use of a rotating gate mechanism to control stack motion. The rotating gate mechanism is positioned at the side of the unit and prevents the second stack from sliding forward as long as any packs remain in the first stack. This is because the packages in the front stack prevent the gate from rotating.

When the first stack is depleted, the gate releases, allowing the second stack to slide forward and replace the first stack. The operator can then replace the second stack.

DETAILED DESCRIPTION OF THE INVENTION

Figure 1:
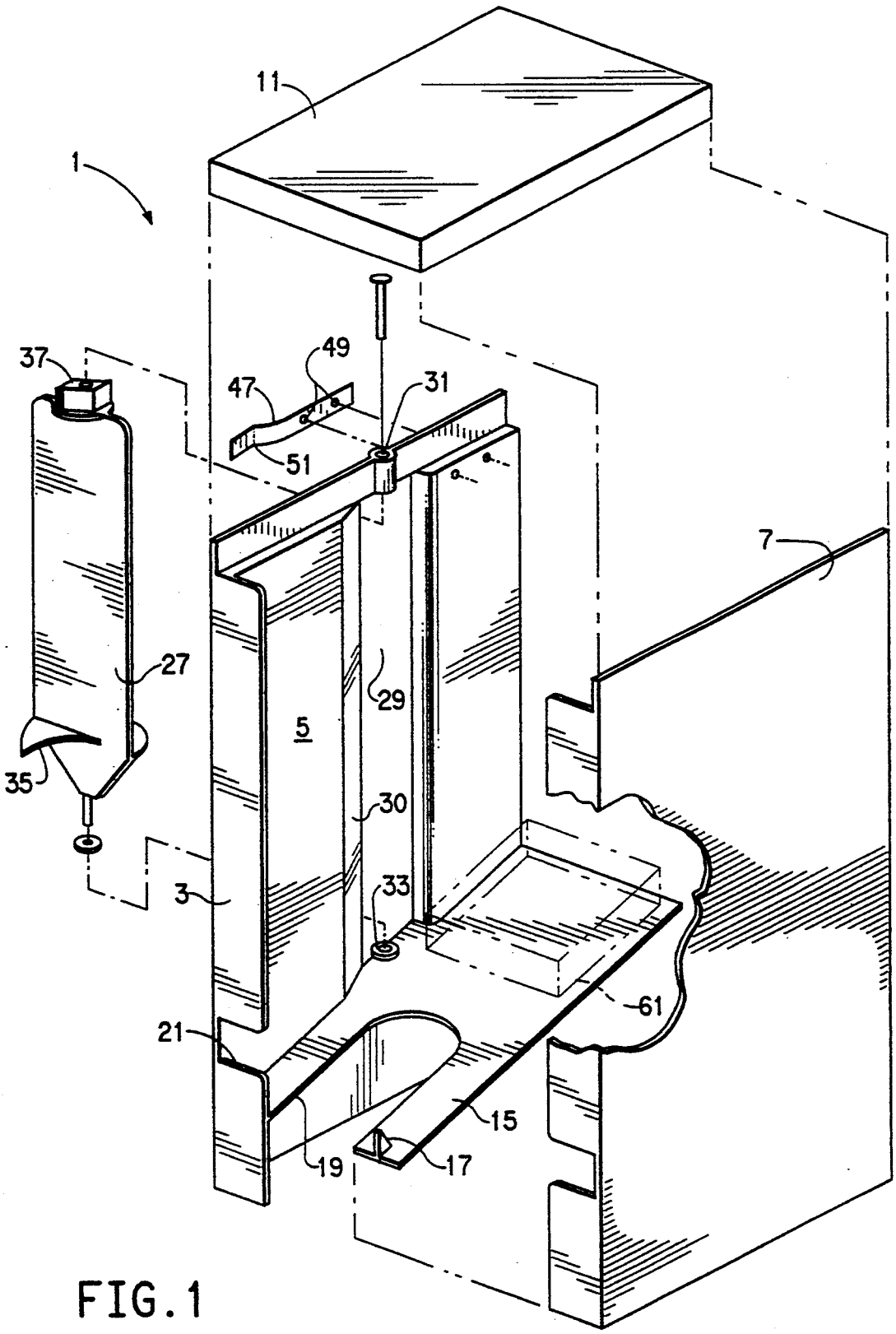
FIG. 1 is an exploded perspective view, partially broken away, of our merchandiser. A single package of cigarettes is shown in phantom.

Our merchandiser 1 is shown in an exploded perspective view in FIG. 1. It includes a front wall 3, left side wall 5, right side wall 7, back wall 9 and top 11. It has a sloped inner surface 15, sloping to the front, which holds the columns of cigarette packages. The sloped surface has a stop element 17 at its lower end to stop downward sliding of the packages, and a finger opening 19 to enable the user to grasp and remove a pack. The pack is removed through package removal opening 21 in front wall 3.

The merchandiser is made to hold two columns of packages, a rear. ("back-up") column 63 and a front ("sell") column 65. The lower package in the front column has been designated as 67. As will be described below, the rear column 63 becomes the front column 65 when all of the packages have been removed from the front column.

It is desirable to keep the rear column separated from the front column during the period that the front column is being dispensed. A turnstile or rotating gate 27 is used for this purpose, and normally intervenes between the front and rear columns of packages. The gate is fitted within a slot 29 in left side wall 5 and, preferably, is almost as high as side wall 5. It is mounted on upper pivot 31 and lower pivot 33. The gate carries a control cam 37 at its upper end, which engages with leaf spring 47, the spring being mounted on wall 5 with screws 49 and having a bend 51 so as to fit against the control cam 37. Control cam 37 and rotating gate 27 are fixed against rotation relative to one another.

Preferably, walls 5 and 7 should be spaced apart a distance only slightly greater than the width of the packages being dispensed. This assures that the rotating gate 27, described below, will always be in a position close enough to control movement of packages between the rear and front column areas.

The control cam 37 includes forward surfaces 39 and rear surfaces 43 (See FIG. 10), the rear surface acting as a control surface. The outer end of each forward surface 39 has a catch 41 to engage with the end of spring 47 to prevent reverse rotation of the cam and so the gate. Reverse rotation, as seen in the figures, would be a counterclockwise rotation.

A gate closure cam 35 is mounted near the lower end of the rotatable gate 27, on each side of the gate. As will be described below, this closure cam, acting in conjunction with a package sliding by it, causes gate 27 and so the control cam 37 to be rotated clockwise a sufficient amount so that the control cam is snapped into a new position 180° from its prior position. This results in renewed gating action after the packages of the rear column have passed by.

Figure 2:
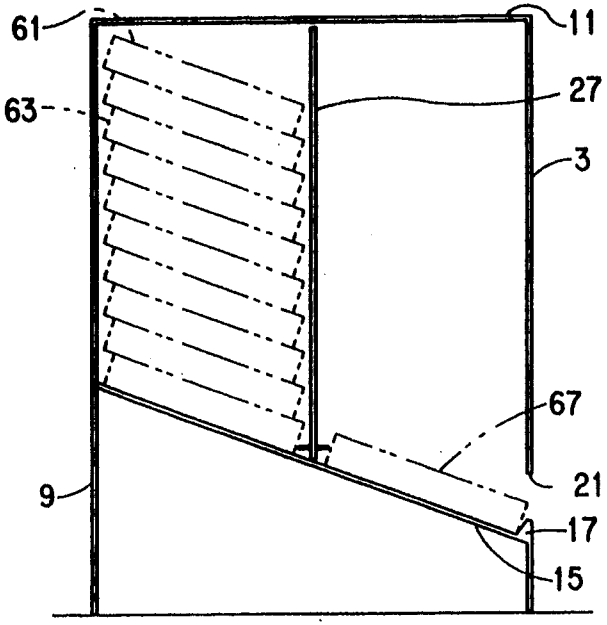
FIG. 2 is a vertical section from the side showing the merchandiser with only one, last package in the front or "sell" column.
Figure 3:
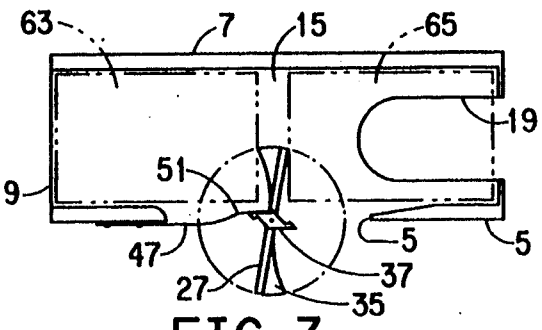
FIG. 3 is a top plan view of the unit of FIG. 2.

The operation of our merchandiser is shown sequentially in FIGS. 2 to 9. FIGS. 2 and 3 show the unit with a full rear column 63, and but one pack left in the front column 65. As can be seen in FIG. 3, gate 27 is held against rotation by whatever packages remain in the front column (even if only a single package), since these packages prevent clockwise rotation of the gate. The gate is also held against rotation by the pressure of spring 47 on the rear surface of control cam 37. This spring pressure by itself is insufficient, however, to prevent rotation being caused by packages in the rear column tending to slide down sloped surface 15, once there are no packages left in the front column.

Figure 4:
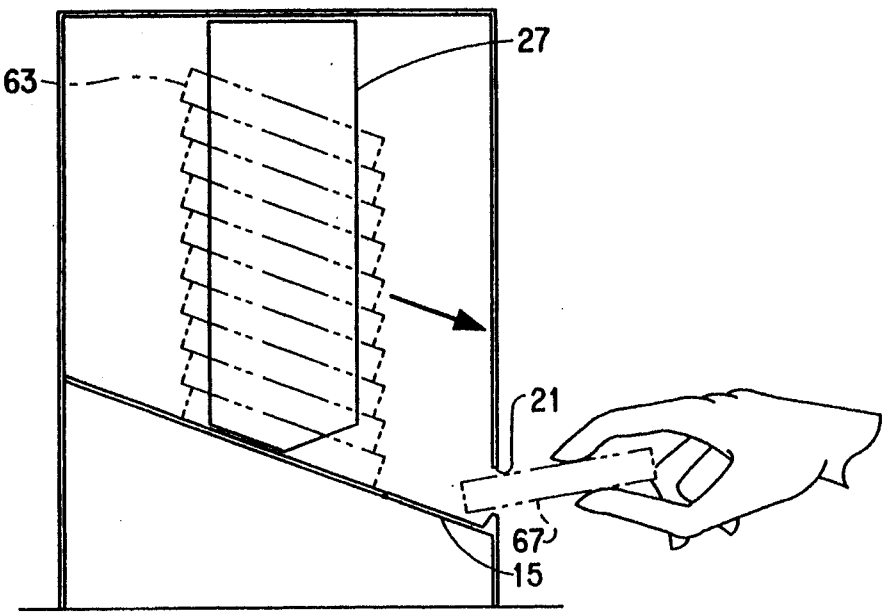
FIG. 4 is similar to FIG. 2, but showing the last package being withdrawn from the "sell" column, showing the back-up column sliding downhill (to the right in the figure), pushing the inner flap of the rotating gate aside. The gate has rotated clockwise (as seen in the figures) about its vertical axis, allowing the back-up column to slide forward and become the "sell" column.
Figure 5:
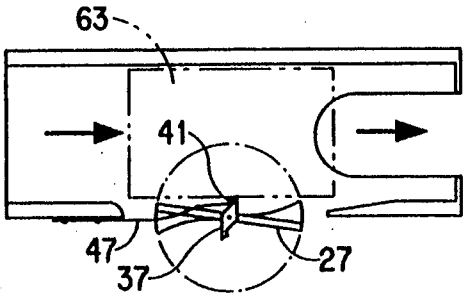
FIG. 5 is a top plan view of the unit of FIG. 4, showing the gate in its released position.
Figure 6:
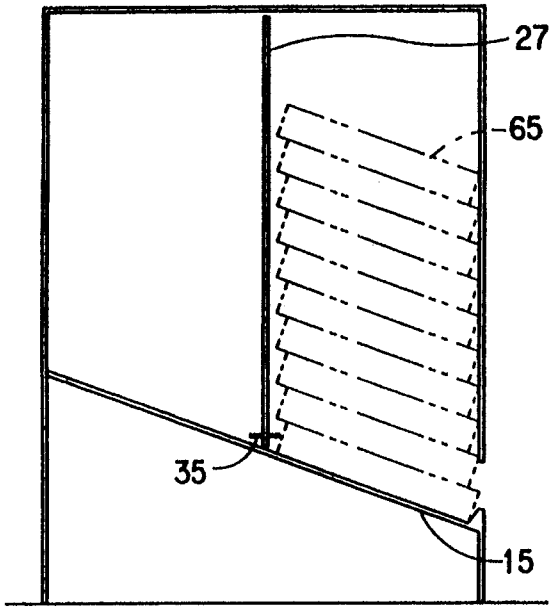
FIG. 6 is similar to FIG. 4, except that the back-up column has now moved fully to the right, becoming the "sell" column, and the gate has returned to it latched or closed position.
Figure 7:
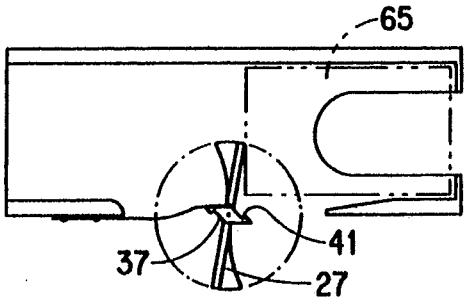
FIG. 7 is a top plan view of FIG. 6.

In FIG. 4 the last package 67 is shown being removed from the front column. Since no front packages remain to block its rotation, rotating gate 27 is released (FIG. 5), permitting the rear column 63 of packages to slide forward in the direction of the arrow and become a new front column 65, as shown in FIG. 6. Rotating gate 27, with pressure from spring 47, then rotates about 90 ° and so resumes a blocking position. The rear area can then be filled with a new rear column 63.

Figure 8:
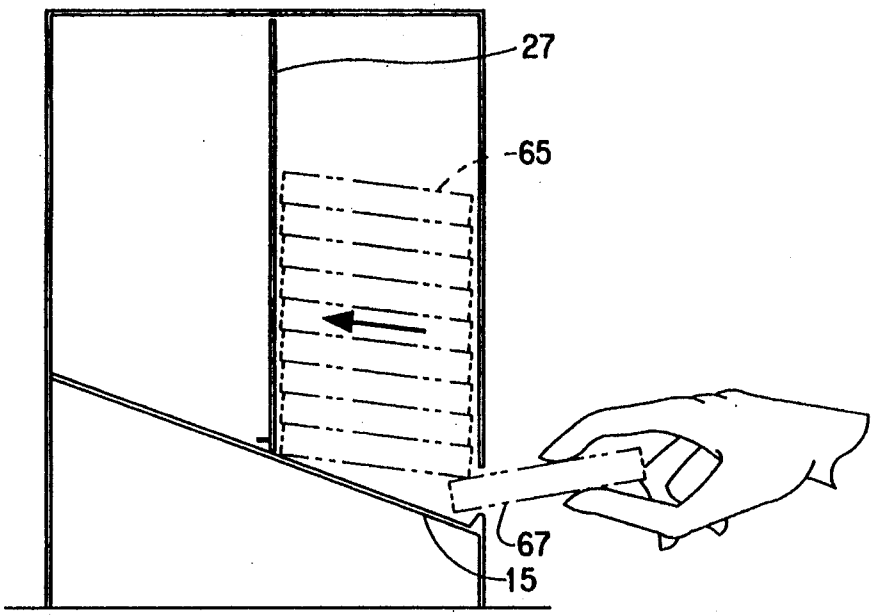
FIG. 8 is similar to FIG. 6, except that now the rear column is empty and a package is being removed from the new "sell" column; this tends to push that entire column to the rear. The column cannot move to the rear, however, because it is stopped by the gate.
Figure 9:
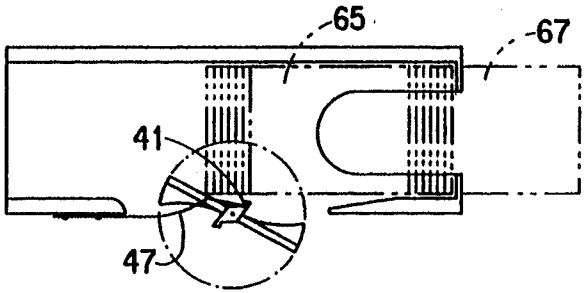
FIG. 9 is a top plan view of FIG. 8, showing how the gate is locked against counterclockwise rotation, and, so, prevents packages in the front column from moving toward the rear.

When the rear column is empty, removal of a package from the front column 65 has a tendency to cause the remainder of the front column to push backwards (FIG. 8). Rotating gate 27 prevents this, because the gate can rotate counterclockwise only a limited amount. This counterclockwise rotation is prevented by spring 47 engaging with protruding catch 41 on the end of the forward surface 39 of control cam 37.

Figure 10:
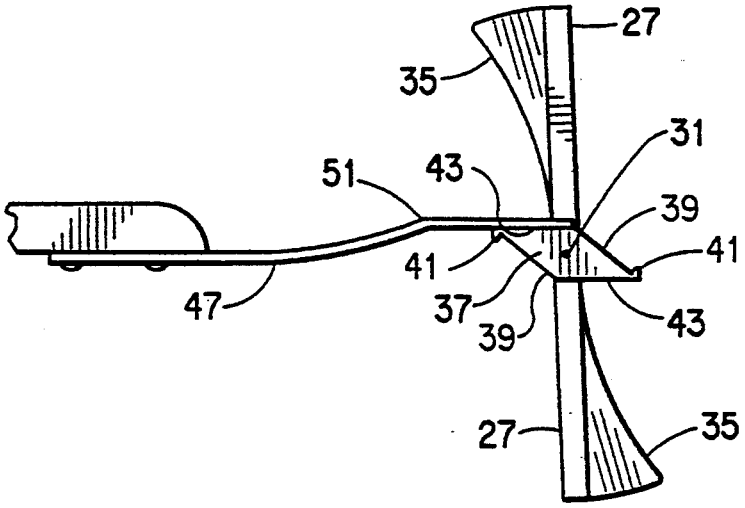
FIG. 10 is an enlarged plan view of the control cam and revolving gate.

An enlarged plan view of the control cam 37 on rotating gate 27 is shown in FIG. 10. The control cam is rhombic in shape and secured to the gate 27 for common rotational motion about pivot 31 (and lower pivot 33, FIG. 1). Each adjacent pair of sides is made up of a forward surface 39 and a rear surface 43. Normally, spring 47 presses against rear surface 43, holding control cam 37 in place and, so, holding gate 27 against rotation. When the last package has been removed from front column 65, the pressure of the packages in the rear column 63 is sufficient to cause gate 27 to rotate clockwise against the pressure of spring 47, allowing the rear column to move forward and become front column 65. Gate closure cam 35 is located toward the bottom of gate 27, and the bottom moving package presses against it; this causes control cam 37 to turn sufficiently past center (in a clockwise direction) so that the spring will cause further rotation. As a result, the rear surface 43 on the opposite side of the cam will now engage the spring 47, and the unit will now be ready to receive a refill of rear column 63.

As noted above with respect to FIGS. 8 and 9, there is a tendency for upper packages to be pushed backwards when removing the lower package if the rear column area is empty. This is prevented because gate 27 is limited in its counterclockwise motion. Control cam 37 includes a protruding catch 41 at the outer end of its forward surface. This catch engages with the end of spring 47 to prevent more than nominal counterclockwise rotation.

Thus, it can be seen that we have invented a package merchandiser which permits removal of individual packages from the bottom of a front column of packages, automatic refill of the front column from a rear column, and provision for a rear column which can be refilled while the front column is in use.

We claim:

1. A package merchandiser, said merchandiser including a housing, said housing having a pair of opposing side walls, a fixed sloping ramp between said side walls, an area between said side walls defining a front package column and a rear package column, said front and rear package columns being adjacent to one another, said sloping ramp being in both said front package column and said rear package column, to hold packages in both said columns, said sloping ramp sloping downwardly toward said front package column, whereby packages contained in said rear package column tend to slide toward said front package column, a rotating gate mounted proximate to one of said walls and pivoted about a vertical axis, a portion of said rotating gate projecting between said front and rear columns, and the presence of any packages in said front package column preventing rotation of said gate, and the absence of any packages in said front package column permitting rotation of said gate, whereby packages in said rear package column can be released to slide down said sloping ramp, and into said front package column, only when no packages are present in said front column, and said rotating gate being self-resetting after said packages in said rear package column have slid down said sloping ramp into said front package column, whereby new packages can thereafter be loaded into said rear package column.

2. A package merchandiser as set forth in claim 1 including a vertical slot in one of said walls, and said rotating gate being positioned in said slot.

3. A package merchandiser as set forth in claim 2 in which the spacing of said sidewalls from one another is small enough to insure engagement between said rotating gate and packages in said front and rear package columns.

4. A package merchandiser, said merchandiser including a housing, a fixed sloping ramp within said housing, areas above said sloping ramp, walls defining a front package column and a rear package column, said front and rear package columns being proximate to one another, said sloping ramp sloping downwardly toward and into said front package column, whereby packages contained in said rear package column tend to slide toward said front package column, a self-resetting rotating gate pivoted about a vertical axis, said rotating gate being positioned with a portion of said rotating gate projecting between said areas, such that the presence of any packages in said front package column prevents rotation of said gate, and the absence of any packages in said front package column permits rotation of said gate, whereby packages in said rear package column can be released to slide down said sloping ramp and into said front package column only when no packages are present in said front column.

5. In a package merchandiser configured to hold a lower stack of similar packages and an upper stack of similar packages, said stacks resting on a common fixed sloping surface, said sloping surface sloping downwardly in the direction of said lower stack, that improvement including self-resetting control means positioned proximate to said sloping surface, said control means preventing motion of said upper stack down said sloping surface toward said lower stack when at least one package is present in said lower stack, and said control means permitting motion of said upper stack down said sloping surface when no packages are present in said lower stack, and a package removal opening in a front side of said package merchandiser for dispensing packages in said lower stack which are resting on said sloping surface.

6. In a package merchandiser as set forth in claim 5 that improvement in which said control means is a rotating gate having a vertical axis, and said rotating gate being positioned to press against any packages in said lower stack and thereby being prevented from rotation.

7. A package merchandiser, said merchandiser including a housing, said housing having a pair of opposing side walls, a sloping ramp between said side walls, an area between said side walls defining a front package column and a rear package column, said front and rear package columns being adjacent to one another, said sloping ramp sloping downwardly toward said front package column, whereby packages contained in said rear package column tend to slide toward said front package column, a rotating gate mounted proximate to one of said walls and pivoted about a vertical axis, a portion of said rotating gate projecting between said front and rear columns, the presence of any packages in said front package column preventing rotation of said gate, and the absence of any packages in said front package column permitting rotation of said gate, a control cam having a common rotational axis with said rotating gate, said control cam being fixed against rotation relative to said rotating gate, said control cam having a control surface, and a leaf spring mounted in operative relationship with said control cam and normally pressing against said control surface to position said rotating gate between said front package column and said rear package column, whereby packages in said rear package column can be released to slide down said sloping ramp only when no packages are present in said front column.

8. A package merchandiser as set forth in claim 7 including a catch on said control cam positioned for locking engagement with said leaf spring to prevent reverse rotation of said control cam and said rotating gate.

9. A package merchandiser, said merchandiser including a housing, a sloping ramp within said housing, areas above said sloping ramp, walls defining front package columns and rear package columns, said front and rear package columns being proximate to one another, said sloping ramp sloping downwardly toward said front package column, whereby packages contained in said rear package column tend to slide toward said front package column, a rotating gate pivoted about a vertical axis, said rotating gate being positioned with a portion of said rotating gate projecting between said areas, such that the presence of any packages in said front package column prevents rotation of said gate, and the absence of any packages in said front package column permits rotation of said gate, control cam having a common rotational axis with said rotating gate, said control cam being fixed against rotation relative to said rotating gate, said control cam having a control surface, and a leaf spring mounted in operative relationship with said control cam and normally pressing against said control surface to position said rotating gate between said front package column and said rear package column, whereby packages in said rear package column can be released to slide down said sloping ramp only when no packages are present in said front column.

10. A package merchandiser as set forth in claim 9 including a catch on said control cam positioned for locking engagement with said leaf spring to prevent reverse rotation of said control cam and said rotating gate.

11. In a package merchandiser configured to hold a lower stack of similar packages and an upper stack of similar packages, said stacks resting on a common sloping surface, said sloping surface sloping downwardly in the direction of said lower stack, that improvement including control means positioned proximate to said sloping surface, said control means preventing motion of said upper stack down said sloping surface toward said lower stack when at least one package is present in said lower stack, and said control means permitting motion of said upper stack down said sloping surface when no packages are present in said lower stack, said control means being a rotating gate having a vertical axis, and said rotating gate being positioned to press against any packages in said lower stack and thereby being prevented from rotation, a control cam having a common rotational axis with said rotating gate, said control cam being fixed against rotation relative to said rotating gate, said control cam having a control surface, and a leaf spring mounted in operative relationship with said control cam and normally pressing against said control surface to position said rotating gate between said lower stack of packages and said upper stack of packages to provide terms having the proper antecedent basis.

12. In a package merchandiser as set forth in claim 11, that improvement in which said control means includes a catch on said control cam positioned for locking engagement with said leaf spring to prevent reverse rotation of said control cam and said rotating gate.

13. A package merchandiser, said merchandiser including a housing, said housing having a pair of opposing side walls, a sloping ramp between said side walls, an area between said side walls defining a front package column and a rear package column, said front and rear package columns being adjacent to one another, said sloping ramp sloping downwardly toward said front package column, whereby packages contained in said rear package column tend to slide toward said front package column, a rotating gate mounted proximate to one of said walls and pivoted about a vertical axis, a portion of said rotating gate projecting between said front and rear columns, the presence of any packages in said front package column preventing rotation of said gate, and the absence of any packages in said front package column permitting rotation of said gate, said rotating gate carrying a closure cam so positioned and dimensioned as to interact with a passing package to cause further rotation of said gate and thereby insure return of said gate to a position to prevent packages from passing said gate, whereby packages in said rear package column can be released to slide down said sloping ramp only when no packages are present in said front column.

14. A package merchandiser, said merchandiser including a housing, a sloping ramp within said housing, areas above said sloping ramp, walls defining front package columns and rear package columns, said front and rear package columns being proximate to one another, said sloping ramp sloping downwardly toward said front package column, whereby packages contained in said rear package column tend to slide toward said front package column, a rotating gate pivoted about a vertical axis, said rotating gate being positioned with a portion of said rotating gate projecting between said areas, such that the presence of any packages in said front package column prevents rotation of said gate, and the absence of any packages in said front package column permits rotation of said gate, and said rotating gate carrying a closure cam so positioned and dimensioned as to interact with a passing package to cause further rotation of said gate and thereby insure return of said gate to a position to prevent packages from passing said gate, whereby packages in said rear package column can be released to slide down said sloping ramp only when no packages are present in said front column.

* * * * *